US005818011A

United States Patent [19]

Ito et al.

[11] Patent Number: 5,818,011

[45] Date of Patent: Oct. 6, 1998

[54] ELECTRICALLY CONTROLLED IRON FOR PRESSING CLOTHING AND TEXTILES WITH AUTOMATIC SHUTOFF FUNCTION

[75] Inventors: Shinichi Ito, Kobe; Tadashi Ando, Nara-ken; Yoshio Fukushima, Osaka, all of Japan

[73] Assignee: Matsushita Electric Industrial Co., Ltd., Osaka, Japan

[21] Appl. No.: 620,425

[22] Filed: Mar. 22, 1996

[30] Foreign Application Priority Data

| | | | |
|---|---|---|---|
| Mar. 31, 1995 | [JP] | Japan | 7-075469 |
| Jun. 6, 1995 | [JP] | Japan | 7-139079 |
| Sep. 7, 1995 | [JP] | Japan | 7-229825 |

[51] Int. Cl.[6] ..... D06F 75/08

[52] U.S. Cl. ..... 219/257; 219/250

[58] Field of Search ..... 219/257, 256, 219/250, 245; 38/74, 82

[56] References Cited

U.S. PATENT DOCUMENTS

| | | | |
|---|---|---|---|
| 4,130,955 | 12/1978 | Baumgartner et al. | 219/257 |
| 4,455,473 | 6/1984 | Schwob | 219/245 |
| 4,523,079 | 6/1985 | Albinger, Jr. | 219/254 |
| 4,686,352 | 8/1987 | Nawrot et al. . | |

FOREIGN PATENT DOCUMENTS

| | | |
|---|---|---|
| 61-90699 | 5/1986 | Japan . |
| 62-144699 | 6/1987 | Japan . |
| 62-181099 | 8/1987 | Japan . |
| 62-181100 | 8/1987 | Japan . |
| 2-17100 | 1/1990 | Japan . |
| 2-189195 | 7/1990 | Japan . |
| 3-268796 | 11/1991 | Japan . |
| 3-268797 | 11/1991 | Japan . |

*Primary Examiner*—John A. Jeffery
*Attorney, Agent, or Firm*—Pollock, Vande Sande & Priddy

[57] ABSTRACT

An output voltage of a commercial power source 1 is rectified through a diode 2, and partially dropped at a voltage drop element 19. Electric power supply to a heater 8 is controlled by a heater controller 7, which is activated in response to an output of a heater control actuator 4. A timer 5 counts time. When a predetermined period of time has passed, heater control actuator 4 causes heater controller 7 to open the power supply circuit of heater 8 so as to forcibly stop the power supply to heater 8. An output terminal of voltage drop element 19 is connected in series with at least two of heater control actuator 4, timer 5 and sensor 20.

4 Claims, 8 Drawing Sheets

ELECTRICALLY CONTROLLED IRON FOR PRESSING CLOTHING AND TEXTILES WITH AUTOMATIC SHUTOFF FUNCTION

BACKGROUND OF THE INVENTION

1. Field of the Invention

The present invention generally relates to an electrically controlled iron for pressing clothing and textiles chiefly for household use.

2. Prior Art

FIG. 12 shows a circuit diagram of a conventional electronic iron. An output voltage of a commercial power source 1 is rectified by a diode 2, and is partially dropped by a voltage drop element 3. The remainder of the voltage is applied to each of a heater control actuator 4, a timer 5, and a sensor 6 connected in parallel with each other, thereby operating each of them.

The heater control actuator 4 is connected to a heat controller 7 to forcibly open the power supply circuit of a heater 8. The heater 8 is, of course, provided to heat up the pressing base or soleplate of the iron to a predetermined ironing temperature. The sensor 6 detects the movement and attitude of the iron. In response to an output of sensor 6, the timer 5 starts its counting-up operation.

More specifically, the timer 5 detects the passage of a predetermined period of time, and sends a time-up signal to the heater control actuator 4. In response to the time-up signal, the heater control actuator 4 sends a shutoff signal to the heater controller 7 to forcibly open the power supply circuit of the heater 8, thereby stopping the power supply to the heater 8.

The heater controller 7, constituted by a bidirectional thyrister, a relay and other components, operates in response to the shutoff signal received from the heater control actuator 4. When electric power is first supplied from the commercial power source 1, heater controller 7 is situated in the closed position so that heater 8 can be electrically connected to the commercial power source 1 via a thermostat 9. Thus, the heater 8 receives electric power and its operating temperature is controlled by the thermostat 9.

The sensor 6 detects whether the iron is used or not, depending on the fact that the iron 10 is frequently or randomly moved when it is used by an operator as shown in FIG. 13A, otherwise the iron 10 is left stationarily in the rest position as shown in FIGS. 13B and 13C. Hence, the sensor 6 detects the movement of iron 10 to judge that iron 10 is used when the iron 10 is moved and is not used when it is not moved.

The sensor 6 includes a ball 13 rollable inside the case 11 thereof along the slope formed on the bottom thereof, as shown in FIG. 14. A photo coupler 12 is provided at the lowest position of the slope where the ball 13 can be stationarily stopped when no acceleration or inertial force is applied on the ball 13.

The photo coupler 12 comprises a light emitting element 12*a* and a light receiving element 12*b* coupled in a predetermined positional relationship in the casing thereof, as shown in FIG. 15. The positional relationship between light emitting element 12*a* and light receiving element 12*b* is defined precisely in such a manner that the light is transmitted from the light emitting element 12*a* to light receiving element 12*b* via the spherical surface of ball 13 settled in its home position (i.e. the lowest position of the slope).

In other words, only when the ball 13 is stopped at its home position, the light emitted from the light emitting element 12*a* can be correctly reflected toward light receiving element 12*b* by the surface of ball 13 so as to guide the light into light receiving element 12*b*, thereby turning on light receiving element 12*b*. Otherwise (i.e. without presence of ball 13 at its home position), no light is received by the light receiving element 12*b*; hence, turning off of light receiving element 12*b* can be expected in such a case.

Accordingly, detecting a collector voltage Vc of receiving element 12*b* makes it possible to judge whether the iron 10 is used or not. More specifically, when the collector voltage Vc causes pulsatile change as shown in FIG. 16A, it can be concluded that the iron 10 is presently used by the operator. When the collector voltage Vc remains at a constant value (a predetermined low level or a predetermined high level) without causing substantial change for a long time, it can be concluded that the iron 10 is not in use.

The timer 5 detects the passage of a predetermined period of time when no pulse voltage is received from sensor 6 (i.e. when the iron 10 is not used), so as to activate the heater control actuator 4 after the passage of the predetermined period of time. The heater control actuator 4 causes the heater controller 7 to stop the power supply to the heater 8.

When the iron 10 is used, the sensor 6 generates the pulse voltage which is entered into the timer 5. In response to each of the building-up and trailing-edge of the pulse waveform, count value of timer 5 is reset to zero, preventing the time count from reaching the predetermined value. Hence, the heater control actuator 4 can continuously maintain the heater controller 7 in its ON condition.

However, the above-described conventional electronic iron is characteristic in that the parallel arrangement is adopted to connect each of the heater control actuator 4, the timer 5 and the sensor 6 to the voltage drop element 3. Assuming that i1, i2 and i3 represent electric currents flowing through the heater control actuator 4, the timer 5 and the sensor 6 respectively, the total electric current flowing through the voltage drop element 3 will amount to the value (i1+i2+i3).

It is further assumed that V1 represents an output voltage of diode 2 as a result of application of electric power of the commercial power source 1, while V2 represents a voltage applied to each of the heater control actuator 4, timer 5 and sensor 6. Regarding voltage V2 applied to each of heater control actuator 4, timer 5 and sensor 6, it will be restricted to be a small value in view of the durability of them when these components 4, 5 and 6 are constituted by semiconductors, such as integrated circuits, transistors and other equivalent electronic components. It means that the value (V1−V2 ) becomes a significantly large value.

Hence, the voltage drop element 3 is subjected to a significantly large amount of electric power consumption whose value amounts up to (V1−V2)×(i1+i2+i3).

This electric power consumption turns into a fairly large amount of heat generation in the voltage drop element 3.

Hence, as shown in FIG. 17, it was necessary to mount or dispose the voltage drop element 3 separately and far from a printed circuit board 15, when the voltage drop element 3 was constituted by a resistance 14. In this case, voltage drop element 3 needs to be connected to the printed circuit board 15 via leads 16. Such a separate arrangement is generally disadvantageous in various aspects.

First, when the resistor 14 is provided out of and far from the printed circuit board 15, it is necessary to specially provide leads 16, crimp-style terminals 17 for firmly connecting the ends of leads 16 to both ends of resistance 14, and a tube 18 covering the resistance 14 and crimp-style terminals 17 entirely so as to provide adequate electrical insulation and to prevent heat from transmitting to peripheral parts or surrounding other sensitive components.

Second, the necessity of crimping each terminal 17 and inserting each lead 16 into a mating hole on the printed circuit board 15 will be a tough barrier to be overcome for realizing perfect automatization of the mounting operation of this kind of electronic component assembly, increasing costs for materials and manufacturing, as well as assembling difficulty.

Furthermore, the electronic iron is an apparatus normally lacking a space available for mounting an electronic circuit or the like therein due to its unique structural features chiefly comprising a thin hand grip and a heat-generating pressing base or soleplate. Thus, constituting the electronic assembly by separate and complicated components will result in the increase of difficulty in the mounting operation.

SUMMARY OF THE INVENTION

Accordingly, in view of above-described problems encountered in the prior art, a principal object of the present invention is to provide a novel and excellent electronic iron capable of adequately suppressing heat generation at the voltage drop element by minimizing the total electric power consumption thereof, so that the voltage drop element can be mounted on a printed circuit board, and constituting a small-sized electronic circuit unit easily installable in a narrow space, such as a handle grip of the iron.

In order to accomplish this and other related objects, a first aspect of the present invention provides a novel and excellent electronic pressing iron comprising: a diode rectifying an output voltage of a commercial power source; voltage drop means connected to the diode for partially dropping a rectified output voltage of the commercial power source; a plurality of control units connected to the voltage drop means and operated by a voltage supplied through the voltage drop means, wherein the voltage drop means is connected in series with at least two of the plural control units.

According to features of preferred embodiments, the plurality of control units include a heater control actuator controlling power supply to a heater element heating a base of the iron, a sensor detecting the movement of the iron, and a timer responsive to an output of the sensor and causing the heater control actuator to stop power supplied to the heater element after the passage of a predetermined period of time.

The sensor comprises a photo coupler separated into a light emitting portion and a light receiving portion, and a ball rollable in response to the movement of the iron, wherein the light receiving portion constitutes a Darlington amplifier having a pair of a photo transistor and an associated transistor.

The electronic pressing iron may comprise an iron stand mounting an iron body thereon. In this case, the control units comprise a heater control actuator controlling power supply to a heater element heating a base of the iron, a mount sensor detecting the presence of the iron body when it is mounted on the iron stand, and a timer responsive to an output of the mount sensor and causing the heater control actuator to stop power supply to the heater element after the passage of a predetermined period of time.

It is preferable that each of the plural control units is connected in parallel with a capacitor and a Zener diode.

Furthermore, a second aspect of the present invention provides an electronic pressing iron comprising: a diode rectifying an output voltage of a commercial power source; voltage drop means connected to the diode for partially dropping a rectified output voltage of the commercial power source; control means connected to the voltage drop means and operated by a voltage supplied through the voltage drop means; a capacitor; and switching means for switching the connection between the capacitor and the control means, in such a manner that the capacitor is connected in series with the control means when the control means receives electric power through the diode, while the capacitor is connected in parallel with the control means when the control means receives no electric power through the diode.

According to features of preferred embodiments, the electronic pressing iron further comprises a discharge current stop means for stopping current discharged from the capacitor, wherein the discharge current stop means is connected in series with the voltage drop means and the capacitor.

The switching means comprises a first diode connected between the capacitor and the control means, a transistor connected in parallel with a series connection of the capacitor and the first diode, and a second diode connected in parallel with a series connection of the first diode and the control means.

The control means comprises a plurality of control units each being connected in parallel with a dedicated capacitor and a Zener diode.

Moreover, a third aspect of the present invention provides a mounting arrangement of an electronic component assembly including a voltage drop element onto a printed circuit board, whereas the voltage drop element serves as a heat generating source.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS preferred embodiments of the present invention will be explained in greater detail hereinafter, with reference to the accompanying drawings. Identical parts are denoted by an identical reference numeral throughout views.

First Embodiment

Figure 1:
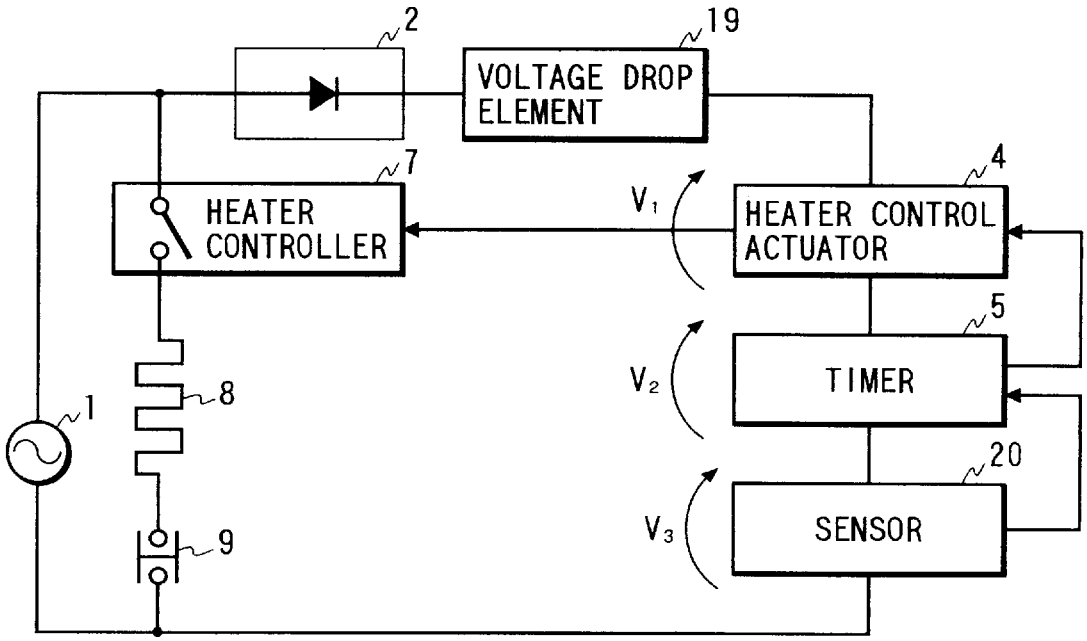
FIG. 1 is a circuit block diagram showing an electronic iron in accordance with a first embodiment of the present invention.

As shown in FIG. 1, a diode 2 rectifies the output voltage of a commercial power source 1 into a direct-current voltage, which is then partially dropped by a voltage drop element 19. The remainder of the voltage is applied to each of a heater control actuator 4, a timer 5, and a sensor 20 connected in series with each other. Each of heater control actuator 4, timer 5 and sensor 20 acts as a control means of the present invention.

The heater control actuator 4 is connected to a heat controller 7 to forcibly open the power supply circuit of a heater 8. The heater controller 7 is interposed in the power supply circuit of the heater 8, i.e. connected to the heater 8 in series. The heater 8 is, of course, provided to heat up the pressing base or soleplate of the iron to a predetermined ironing temperature. The sensor 20 detects the movement and attitude of the iron, generating a pulse voltage when the iron is being moved for use.

Figure 2:
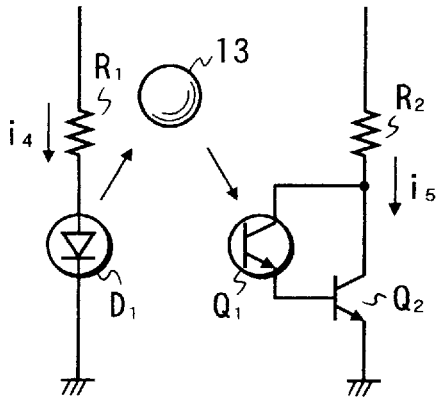
FIG. 2 is a circuit diagram showing a sensor of the iron common to various embodiments of the present invention.

The sensor 20, constituted as shown in FIG. 2, comprises a light emitting diode D1 which emits a light beam when an electric current i4 flows therethrough by the provision of an adjusting resistance R1 serially connected to one end of the diode D1.

A ball 13 acts as a means for directly responding to the movement and attitude of the iron, as explained in the prior art with reference to FIGS. 13A–13C and 14, depending on the fact that the iron, when it is in the used condition, is continuously moved frequently and randomly in various directions, otherwise the iron is left stationarily in the horizontal rest position or the heel rest position.

Configuration and function of the ball 13 is basically the same as that explained in the prior art. The ball 13 stays at its home position (i.e. the lowest position of the slope in the sensor housing, as explained in the prior art) only when the iron is not used, allowing the light emitted from the light emitting diode D1 to reflect correctly toward and enter into a photo transistor Q1. In other words, the photo transistor Q1 is turned on in response to the position of the ball 13 directly reflecting the movement and attitude of the iron.

An output current of the photo transistor Q1 is amplified by a transistor Q2. The combination of two transistors Q1 and Q2 constitutes a Darlington amplifier which is an arrangement specially adopted in this embodiment of the present invention. Accordingly, in response to turning-on of photo transistor Q1, an electric current i5 flows through the transistor Q2 under provision of an adjusting resistance R2. The reason why this embodiment requires the Darlington amplifier is as follows.

To keep a predetermined current i5 flowing through the transistor Q2, electric current i4 flowing through the light emitting diode D1 must be a certain quantity of current. If the electric current i4 is large, the electric current flowing through the voltage drop element 19 will be increased and the overall power consumption will be increased at the voltage drop element 19.

Accordingly, to decrease the power consumption at the voltage drop element 19, it is fundamentally necessary to reduce the current i4 flowing through the light emitting diode D1. However, light emitting quantity from the light emitting diode D1 will be reduced with reducing current i4. To eliminate this drawback, an output current of the photo transistor Q1 is amplified by the transistor Q2, thereby stabilizing the operation of the sensor 20.

The timer 5 is reset in response to the pulse voltage generated from the sensor 6, even after a significant time has passed. The timer 5 restarts its counting operation from the beginning in response to each input of building-up or trailing-edge pulse unless the counting time reaches a predetermined time.

Therefore, when the iron is used, i.e. when the body of iron is moved by a user, timer 5 is reset so frequently that the counting time cannot reach the predetermined time.

On the other hand, when the iron is not used and left stationarily while keeping the electrical connection to the commercial power source 1, the sensor 20 causes no pulse voltage and hence timer 5 will not be reset until the counting time reaches the predetermined time. After the passage of the predetermined period of time, timer 5 sends a time-up signal to heater control actuator 4 to activate it.

The heater control actuator 4 shuts off the heater controller 7 to open the power supply circuit of heater 8, thereby forcibly stopping electric power supply to the heater 8 regardless of the on and off of a thermostat 9 serially connected to the heater 8 in the power supply circuit of the heater 8.

As described above, the first embodiment of the present invention provides a group of heater control actuator 4, timer 5 and sensor 20 arranged in series and connected to the output terminal of the voltage drop element 19. With this circuit arrangement, the magnitude of electric current flowing through the voltage drop element 19 can be set to be a value comparable with the maximum current among all of currents required for activating heater control actuator 4, timer 5 and sensor 20 respectively, rather than the sum of these currents as was so in the conventional circuit. Hence, the electric current flowing through the voltage drop element 19 can be suppressed to a relatively small value.

In this case, the output voltage of voltage drop element 19 is identical with the sum of voltages V1+V2+V3, where V1 represents a voltage applied to the heater control voltage 4, V2 represents a voltage applied to the timer 5, and V3 represents a voltage applied to the sensor 20. It means that the voltage drop amount at the voltage drop element 19 becomes a fairly small value. Accordingly, electric power consumption at the voltage drop element 19 becomes small, causing a small amount of heat generation.

Figure 3:
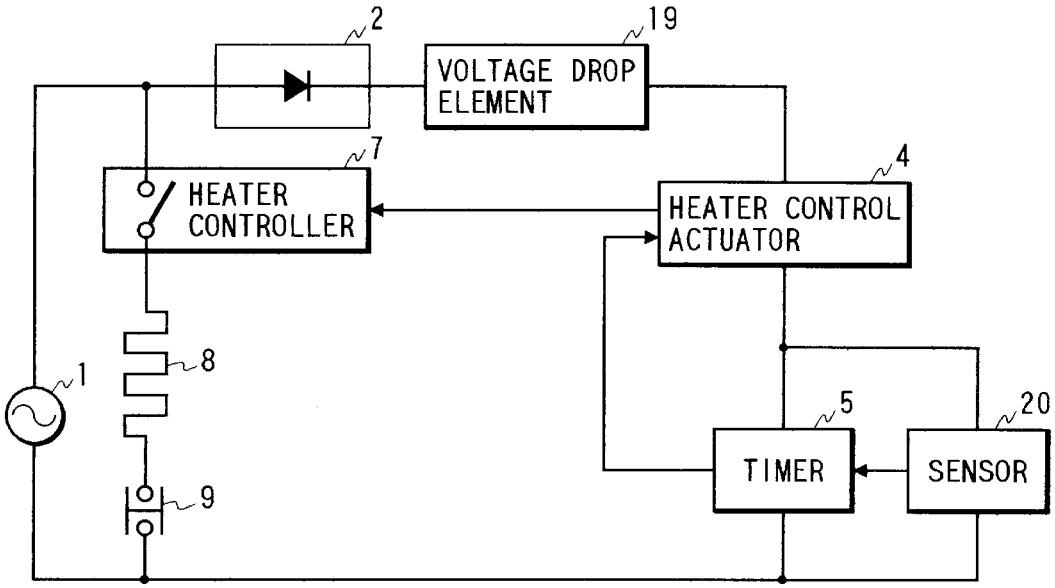
FIG. 3 is a circuit block diagram showing another electronic iron in accordance with the first embodiment of the present invention.

FIG. 3 shows a modification of the first embodiment, according to which heater control actuator 4 and timer 5 are connected in series, but the sensor 20 is connected in parallel to the timer 5. The electric current flowing through the voltage drop element 19 becomes comparable with or not larger than the larger one between two currents, a current flowing through the heater control actuator 4 and a sum of currents flowing through timer 5 and sensor 20. Thus obtained electric current flowing through the voltage drop element 19 is still smaller than the total of the currents required for activating heater control actuator 4, timer 5 and sensor 20 respectively when these control units 4, 5 and 20 are connected in the parallel arrangement.

Figure 4:
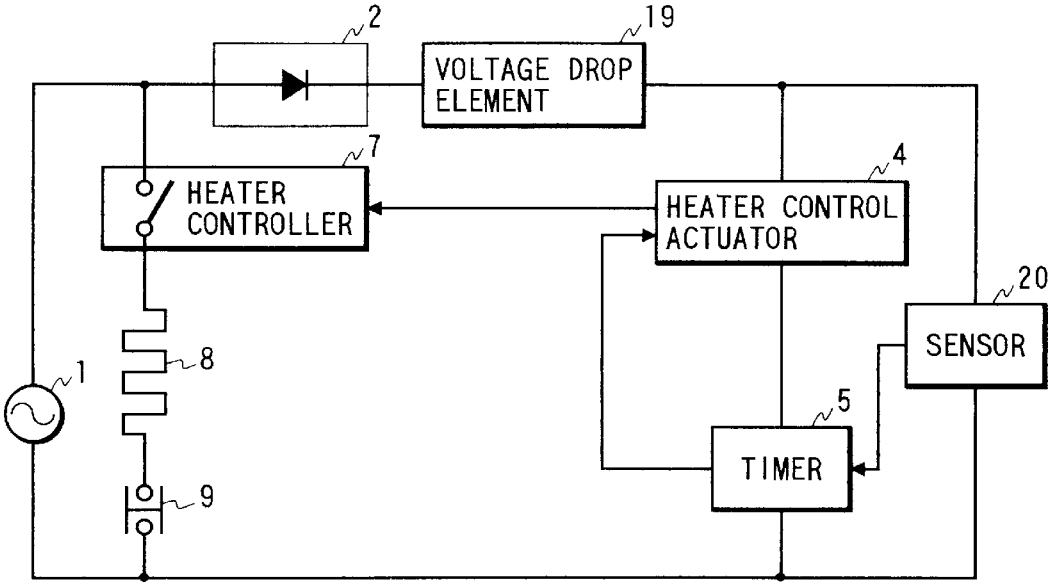
FIG. 4 is a circuit block diagram showing still another electronic iron in accordance with the first embodiment of the present invention.

FIG. 4 shows another modification of the first embodiment, according to which heater control actuator 4 and timer 5 are connected in series, but the sensor 20 is connected in parallel to the serially connected heater control actuator 4 and timer 5. The electric current flowing through voltage drop element 19 becomes a sum of a current flowing through the serially connected heater control actuator 4 and timer 5 and a current flowing through the sensor 20. The-current flowing through the serially connected heater control actuator 4 and timer 5 is comparable with or not larger than the larger one between two currents respectively required for the heater control actuator 4 and timer 5. Thus obtained electric current flowing through the voltage drop element 19 is still smaller than the total of currents required for activating heater control actuator 4, timer 5 and sensor 20 respectively when these control units 4, 5 and 20 are connected in the parallel arrangement.

As apparent from the foregoing description, the first embodiment of the present invention provides an electronic pressing iron comprising: a diode rectifying an output voltage of a commercial power source; voltage drop means connected to the diode for partially dropping a rectified output voltage of the commercial power source; a plurality of control units connected to the voltage drop means and operated by a voltage supplied through the voltage drop means, wherein the voltage drop means is connected in series with at least two of the plural control units.

Hence, it becomes possible to supply the circuit of control means with an electric current whose value is comparable with or not larger than the maximum current among the electric currents required for operating the plural control units respectively, resulting in the reduction of electric current flowing through the voltage drop element.

Furthermore, the sum of voltages applied on plural control units is identical with the required output voltage of the voltage drop element. Series connection of the voltage drop element and at least two control units makes it possible to reduce the required drop amount at the voltage drop element, suppressing overall electric power consumption (i.e. heat generation) at the voltage drop element.

According to the first embodiment of the present invention, the plurality control units are constituted by a heater control actuator controlling power supply to a heater element heating a base or soleplate of the iron, a sensor detecting the movement and attitude of the iron, and a timer responsive to an output of the sensor and causing the heater control actuator to stop power supply to the heater element after the passage of a predetermined period of time.

Hence, it becomes possible to supply the circuit of control means with an electric current whose value is comparable with or not larger than the maximum current among the electric currents required for operating the heater control actuator, the timer and the sensor respectively, resulting in the reduction of electric current flowing through the voltage drop element.

Furthermore, the sum of voltages applied on the heater control actuator, the timer and the sensor respectively is identical with the required output voltage of the voltage drop element. Series connection of the voltage drop element and at least two of the heater control actuators, the timer and the sensor makes it possible to reduce the required drop amount at the voltage drop element, suppressing overall electric power consumption (i.e. heat generation) at the voltage drop element.

The sensor detects the movement and attitude of the iron. Then, the timer starts its counting operation in response to the output of the sensor. And finally, the heater control actuator forcibly stops the power supply to the heater element in response to the passage of a predetermined period of time when counted by the timer. Such an arrangement will improve easiness in use.

Still further, according to the first embodiment of the present invention, the sensor comprises a photo coupler separated into a light emitting portion and a light receiving portion, and a ball rollable in response to the movement of the iron, wherein the light receiving portion constitutes a Darlington amplifier having a pair of a photo transistor and an associated transistor.

With this circuit arrangement, it becomes possible to reduce the current flowing through a light emitting diode since the output current of the photo transistor can be adequately amplified by the Darlington amplifier, bringing the merit of reducing power consumption at the voltage drop element.

Second Embodiment

Figure 5:
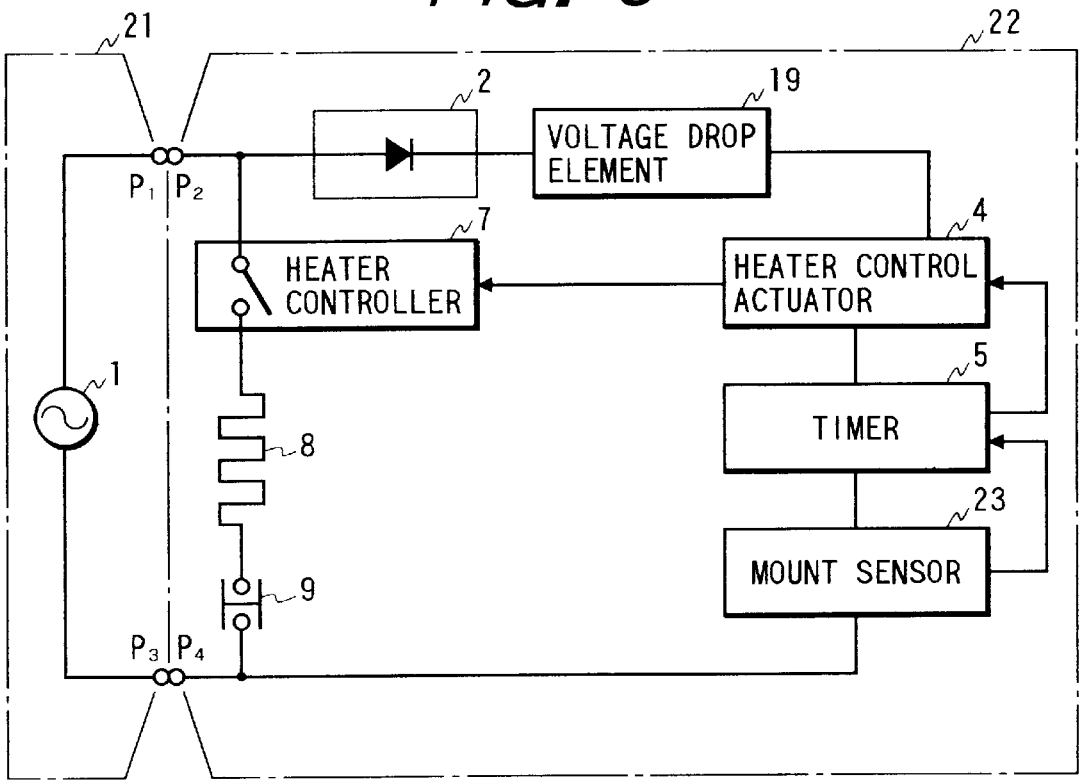
FIG. 5 is a circuit block diagram showing an electronic iron in accordance with a second embodiment of the present invention.

As shown in FIG. 5, a cordless electronic iron is generally separated into two sections, a stand section 21 including a commercial power source 1 and an iron body section 22. When the iron body section 22 is placed on the stand section 21, electrodes P1 and P3 formed on the stand section 21 are brought into contact with electrodes P2 and P4 provided on the iron body section 22 so as to supply electric power from the stand section 21 to the heater 8 in the iron body section 22. Receiving electric power, the heater 8 heats up a pressing base or soleplate of iron body section 22 to a predetermined ironing temperature, thereafter allowing a user to remove iron body section 22 off the stand 21 to use it to press clothing and textiles.

When the iron body section 22 is placed on stand section 21, the diode 2 rectifies the output voltage of commercial power source 1 into a direct-current voltage, which is then partially dropped by a voltage drop element 19. The remainder of the voltage is applied to a heater control actuator 4, a timer 5, and a mount sensor 23 which are connected in series.

The heater controller 7, responsive to an output of the heater control actuator 4, is interposed in the power supply circuit of heater 8 and closes this circuit at the moment the commercial electric power is just turned on.

A thermostat 9, connected in series with the heater 8, acts as a temperature control means for maintaining the temperature of heater 8 at a predetermined ironing temperature by automatically opening or closing the power supply circuit using its conventionally known, temperature sensitive, self-deflecting nature.

The mount sensor 23 detects whether or not the iron body section 22 is precisely placed in position on the stand section 21. The mount sensor 23, when it detects the presence of iron body section 22 on stand section 21, sends a detection signal to the timer 5 to cause the timer 5 to start its counting operation. The timer 5, when its time count reaches a predetermined time, sends a time-up signal to the heater control actuator 4.

In response to the time-up signal, the heater control actuator 4 sends a control signal to the heater controller 7 to open the power supply circuit of heater 8, thereby forcibly stopping the power supply to the heater 8. This is a sort of self-acting safety sequence acting in the event the user forgets disconnecting the plug from the commercial power source 1.

As apparent from the foregoing description, the second embodiment provides a cordless electronic iron comprising a group of serially connected heater control actuator 4, timer 5 and mount sensor 23 which are connected to an output terminal of the voltage drop element 19. Each of heater control actuator 4, timer 5 and mount sensor 23 serves as a control means of the present invention.

Accordingly, the electric current flowing through the voltage drop element 19 can be reduced effectively and the voltage drop amount at the voltage drop element 19 can be reduced correspondingly. It results in the reduction of power consumption at the voltage drop element 19, suppressing heat generation in the voltage drop element 19.

Although FIG. 5 discloses the circuit arrangement of serially connected heater control actuator 4, timer 5 and mount sensor 23, it will be desirable if at least two of these, heater control actuator 4, timer 5 and mount sensor 23 are connected in series in view of reduction of power consumption (i.e. heat generation) at the voltage drop element 19.

Thus, the second embodiment of the present invention provides an electronic pressing comprises, in addition to the essential features of the first embodiment, an iron stand mounting an iron body thereon, wherein the control units comprises a heater control actuator controlling power supply to a heater element heating a base or soleplate of the iron, a mount sensor detecting the iron body when it is mounted on the iron stand, and a timer responsive to an output of the mount sensor and causing the heater control actuator to stop power supply to the heater element after the passage of a predetermined period of time.

Hence, it becomes possible to supply the circuit of control means with an electric current comparable with or not larger than the maximum current among the electric currents required for operating the heat control actuator, the timer and the mount sensor respectively, resulting in the reduction of electric current flowing through the voltage drop element.

Furthermore, the sum of voltages applied on the heater control actuator, the timer and the mount sensor respectively is identical with the required output voltage of the voltage drop element. Series connection of the voltage drop element and at least two of the heater control actuator, the timer and the mount sensor makes it possible to reduce the required drop amount at the voltage drop element, suppressing overall electric power consumption (i.e. heat generation) at the voltage drop element.

The mount sensor detects the presence of iron body when it is placed on the iron stand. Then, the timer starts its counting operation in response to the output of the mount sensor. And finally, the heater control actuator forcibly stops the power supply to the heater element in response to the passage of a predetermined period of time when counted by the timer. Such an arrangement will improve easiness in use.

Third Embodiment

Figure 6:
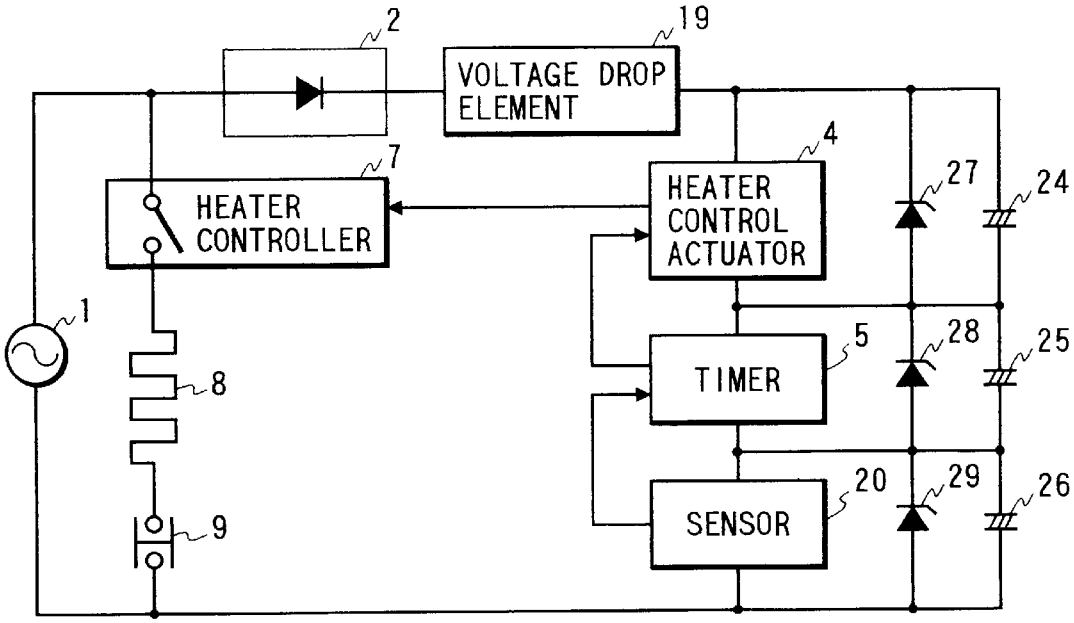
FIG. 6 is a circuit block diagram showing an electronic iron in accordance with a third embodiment of the present invention.

As shown in FIG. 6, a circuit of an electronic iron in accordance with a third embodiment of the present invention comprises a commercial power source 1, a diode 2 connected to one end of commercial power source 1, and a voltage drop element 19 serially connected to diode 2.

Between the other end of commercial power source 1 and the voltage drop element 19, three capacitors 24, 25 and 26 are connected in series. Three Zener diodes 27, 28 and 29 are connected in parallel with these capacitors 24, 25 and 26, respectively.

A heater control actuator 4 is connected in parallel to the first capacitor 24. A timer 5 is connected in parallel to the second capacitor 25. A sensor 20 is connected in parallel to the third capacitor 26. Each of heater control actuator 4, timer 5 and sensor 20 acts as a control means of the present invention.

Capacitors 24–26 serve as stable direct-current power sources capable of supplying stabilized direct current to heater control actuator 4, timer 5 and sensor 20, respectively.

When the commercial power source 1 has the positive polarity in the supply of an alternating electric power, an electric current defined by the resistance value of voltage drop element 19 flows through the serially connected three capacitors 24–26. At the same time, electric current flows each of Zener diodes 27–29, heater control actuator 4, timer 5 and sensor 20.

When the commercial power source 1 has the negative polarity, the diode 2 stops the electric power supply from the commercial power source 1. In this case, capacitors 24–26 supply electric current to heater control actuator 4, timer 5 and sensor 20, respectively. Zener diodes 27–29 cooperate with corresponding capacitors 24–26 to provide the stable direct-current power source for each of heater control actuator 4, timer 5 and sensor 20.

As described in the foregoing description, the third embodiment of the present invention provides a group of serially connected heater control actuator 4, timer 5 and sensor 20, and capacitors 24–26 and Zener diodes 27–29 connected in parallel to these control units 4, 5 and 20. With this circuit arrangement, electric power consumption (i.e. heat generation) at the voltage drop element 19 can be fairly reduced compared with the value obtained when these control units 4, 5 and 20 are connected in a parallel arrangement as was so in the conventional circuit.

Namely, the current flowing through the voltage drop element 19 becomes a value comparable with or not larger than the maximum current among the currents required for actuating heater control actuator 4, timer 5, and sensor 20 respectively. This electric current value is fairly smaller than the sum of all of the currents required for activating heater control actuator 4, timer 5 and sensor 20 respectively when these control units 4, 5 and 20 are connected in the parallel arrangement.

Thus, the third embodiment of the present invention is characterized in that each of the plural control units is connected in parallel with a capacitor and a Zener diode, in addition to the essential features of the first embodiment. Hence, it becomes possible to reduce power loss when the output voltage of the commercial power source is rectified. It also becomes possible to provide a stable direct-current power source for each of plural control units.

Fourth Embodiment

Figure 7:
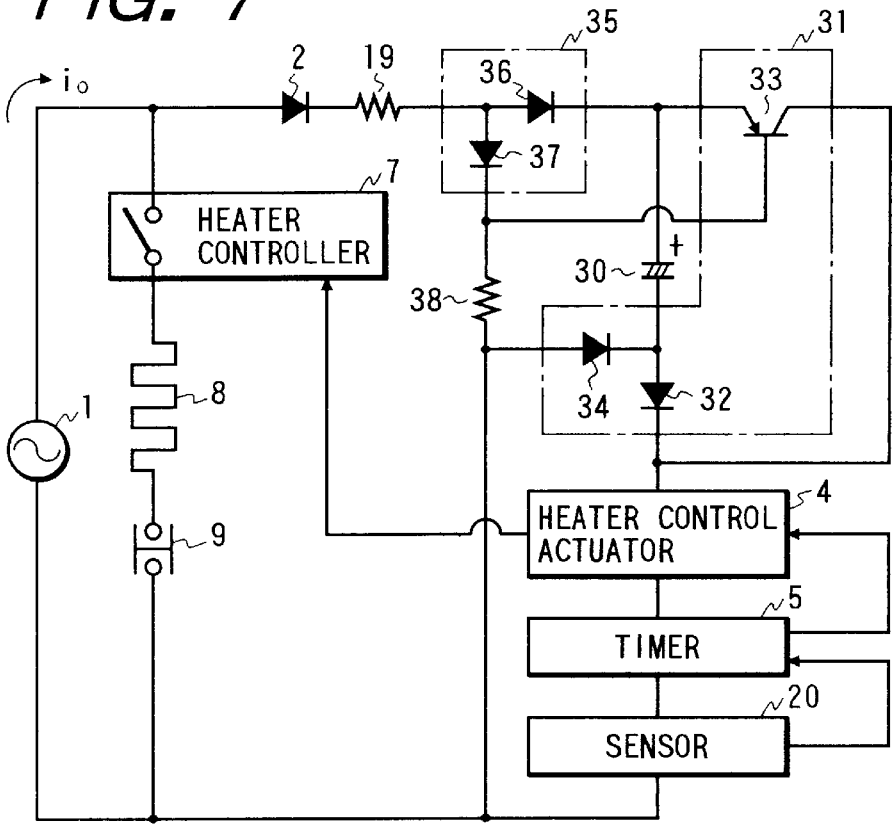
FIG. 7 is a circuit block diagram showing an electronic iron in accordance with a fourth embodiment of the present invention.

FIG. 7 shows a circuit arrangement of a fourth embodiment of the present invention, according to which a capacitor 30 is interposed in a series circuit of a voltage drop element 19, a heater control actuator 4, a timer 5 and a sensor 20.

A switching circuit 31 is provided between the capacitor 30 and the serially connected heater control actuator 4, timer 5 and sensor 20. The switching circuit 31 has a function of switching the connection of capacitor 30 between two patterns. When electric power is supplied to the serially connected control units 4, 5 and 20 through a diode 2 from a commercial power source 1, the capacitor 30 is connected in series with the serially connected control units 4, 5 and 20.

On the contrary, when electric power is not supplied to the serially connected control units 4, 5 and 20 through diode 2 from commercial power source 1, the capacitor 30 is connected in parallel with the serially connected control units 4, 5 and 20.

The switching circuit 31 comprises a first diode 32 interposed between capacitor 30 and the serially connected control units 4, 5 and 20, a transistor 33 connected in parallel with the series connection of capacitor 30 and first diode 32, and a second diode 34 connected in parallel with the series connection of first diode 32 and serially connected control units 4, 5 and 20.

When the commercial power source 1 has the polarity capable of causing an electric current i0, transistor 33 is turned off and therefore the capacitor 30 is connected in series with the serially connected control units 4, 5 and 20. When the commercial power source 1 has the opposite polarity, the transistor 33 is turned on by the electric current discharging from the capacitor 30, thereby connecting the capacitor 30 in parallel with the serially connected control units 4, 5 and 20.

A discharge current stopper 35, consisting of a third diode 36 and a fourth diode 37, prevents the capacitor 30 from discharging the stored electric charge to commercial power source 1 when the polarity of commercial power source 1 is in the direction opposed to the flow direction of electric current i0. The discharge current stopper 35 is interposed between voltage drop element 19 and capacitor 30. Reference numeral 38 represents a current limiting resistance.

An operation of the above-described circuit will be explained hereinafter. When the polarity of commercial power source 1 has the same direction as the current i0, the transistor 33 is turned off and therefore the capacitor 30 is connected in series with the serially connected control units 4, 5 and 20. Hence, the capacitor 30 is charged through the series connection of commercial power source 1, diode 2, voltage drop element 19, and serially connected control units 4, 5 and 20.

In this case, an output voltage of commercial power source can be adequately divided by the voltage drop element 19, the capacitor 30, and the serially connected control units 4, 5 and 20. This is why the voltage applied between both ends of the voltage drop element 19 can be reduced effectively.

Next, when the commercial power source 1 has the polarity opposed to the flow direction of current i0, the transistor 33 is turned on by the electric current discharging from the capacitor 30, so that the capacitor 30 is connected in parallel with a series circuit comprising transistor 33, serially connected control units 4, 5 and 20, and second diode 34. Hence, it becomes possible to operate the serially connected control units 4, 5 and 20 by the electric current discharged from capacitor 30. In this instance, first diode 32 prevents the capacitor 30 from being short-circuited by the conducted transistor 33.

Accordingly, the circuit operates effectively even during the period of time the polarity of commercial power source 1 is opposite to the flow direction of electric current i0, reducing the overall power consumption at the voltage drop element 19.

Furthermore, connecting capacitor 30 in series with the serially connected heater control actuator 4, timer 5 and sensor 20 is effective to reduce the voltage drop amount at the voltage drop element 19, since the capacitor 30 undertakes or receives some of the output voltage of the commercial power source 1 while lowering the percentage of the divided voltage to be imparted on voltage drop element 19. As described previously, the total electric power consumption at voltage drop element 19 can be fairly reduced by the reduction of voltage applied thereon in addition to the smallness of electric current flowing therethrough.

Figure 8:
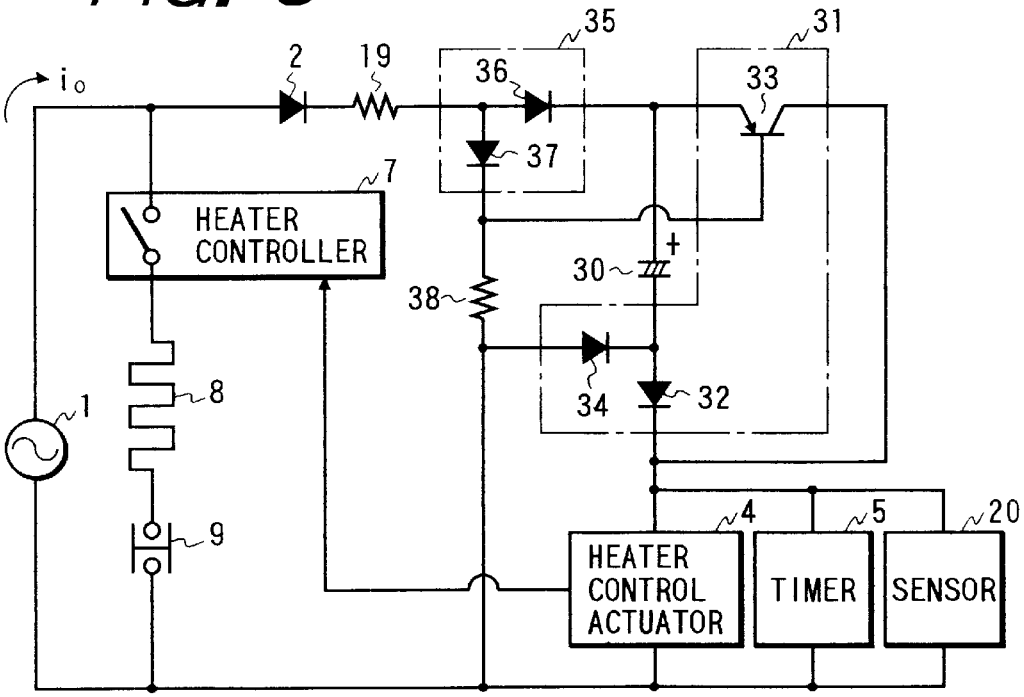
FIG. 8 is a circuit block diagram showing another electronic iron in accordance with the fourth embodiment of the present invention.

Although FIG. 7 shows a group of heater control actuator 4, timer 5 and sensor 20 which are connected in series, it is also desirable to connect capacitor 30 to a parallel circuit consisting of these control units 4, 5 and 20 as shown in FIG. 8. Alternatively, it is also preferable to connect two of heater control actuator 4, timer 5 and sensor 20 in series.

Figure 9:
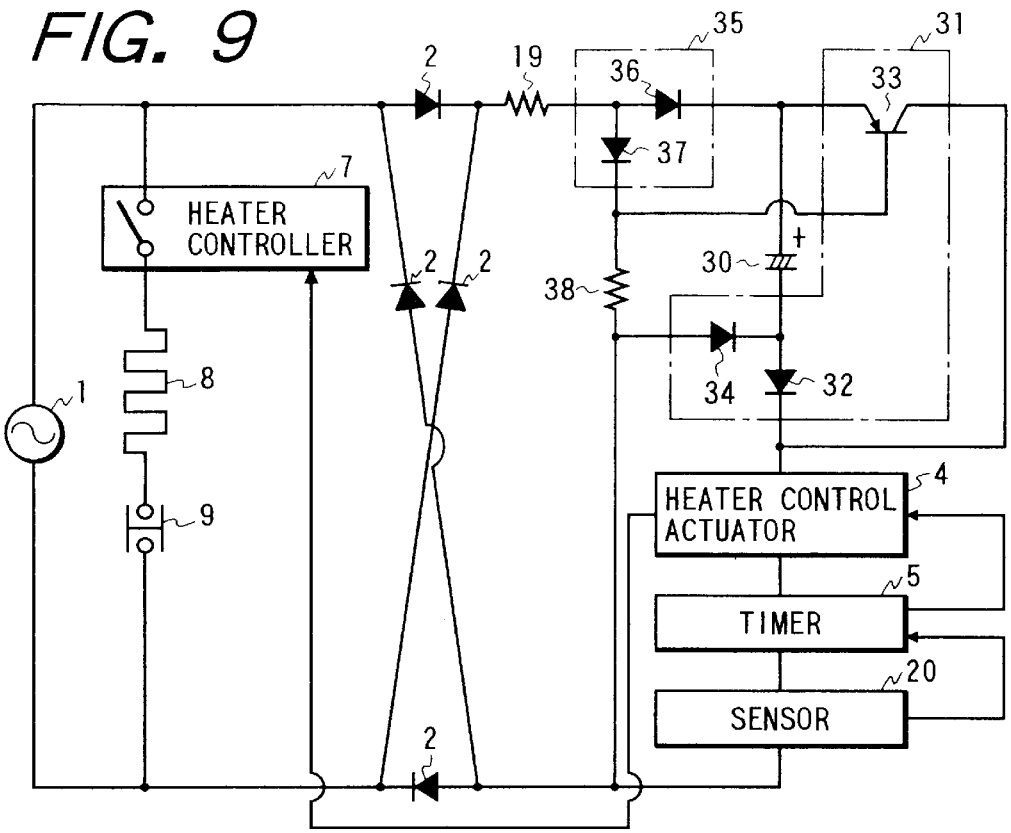
FIG. 9 is a circuit block diagram showing still another electronic iron in accordance with the fourth embodiment of the present invention.

Furthermore, it is needless to say that the circuit of FIG. 7 can be slightly modified into a full-wave rectification circuit by additionally providing plural diodes 2 as shown in FIG. 9.

As apparent from the foregoing description, the fourth embodiment of the present invention provides an electronic pressing iron comprising: a diode rectifying an output voltage of a commercial power source; voltage drop means connected to the diode for partially dropping a rectified output voltage of the commercial power source; control means connected to the voltage drop means and operated by a voltage supplied through the voltage drop means; a capacitor; and switching means for switching the connection between the capacitor and the control means, in such a manner that the capacitor is connected in series with the control means when the control means receives electric power through the diode, while the capacitor is connected in parallel with the control means when the control means receives no electric power through the diode.

When electric power is supplied to the control means through the diode, it becomes possible to connect the control means in series with the capacitor, thereby effectively charging the capacitor and causing a significant amount of voltage drop at the capacitor. On the other hand, when electric power is not supplied to the control means through the diode, it becomes possible to connect the control means in parallel with the capacitor by the switching means activated in response to the discharge current of the capacitor, thereby effectively discharging the electric charge stored in the capacitor to the control means. In response to this discharge current, each control means is operated.

When the control means receives electric power through the diode, the current flowing through the voltage drop element is suppressed to a small value since the capacitor is connected in series with the voltage drop element. The required voltage drop amount is also suppressed to a small value. As a result, overall power consumption at the voltage drop element can be suppressed to a fairly small value.

Furthermore, according to the fourth embodiment of the present invention, there is provided a discharge current stop means for stopping current discharged from the capacitor, wherein the discharge current stop means is connected in series with the voltage drop means and the capacitor.

Hence, it becomes possible to prevent discharge current of the capacitor from returning to the commercial power source, assuring effective discharge of electric charge stored in the capacitor through the control means, thereby stabilizing the operation of each control means.

Yet further, according to the fourth embodiment of the present invention, the switching means comprises a first diode connected between the capacitor and the control means, a transistor connected in parallel with a series connection of the capacitor and the first diode, and a second diode connected in parallel with a series connection of the first diode and the control means.

Thus, it becomes possible to turn on the transistor by the discharge current of the capacitor when no electric power is supplied to the control means through the diode rectifying the output voltage of the commercial power source. In this case, the second diode and the control means can be connected in parallel to the capacitor, so that the electric charge stored in the capacitor can be effectively discharged through the control means.

Fifth Embodiment

Figure 10:
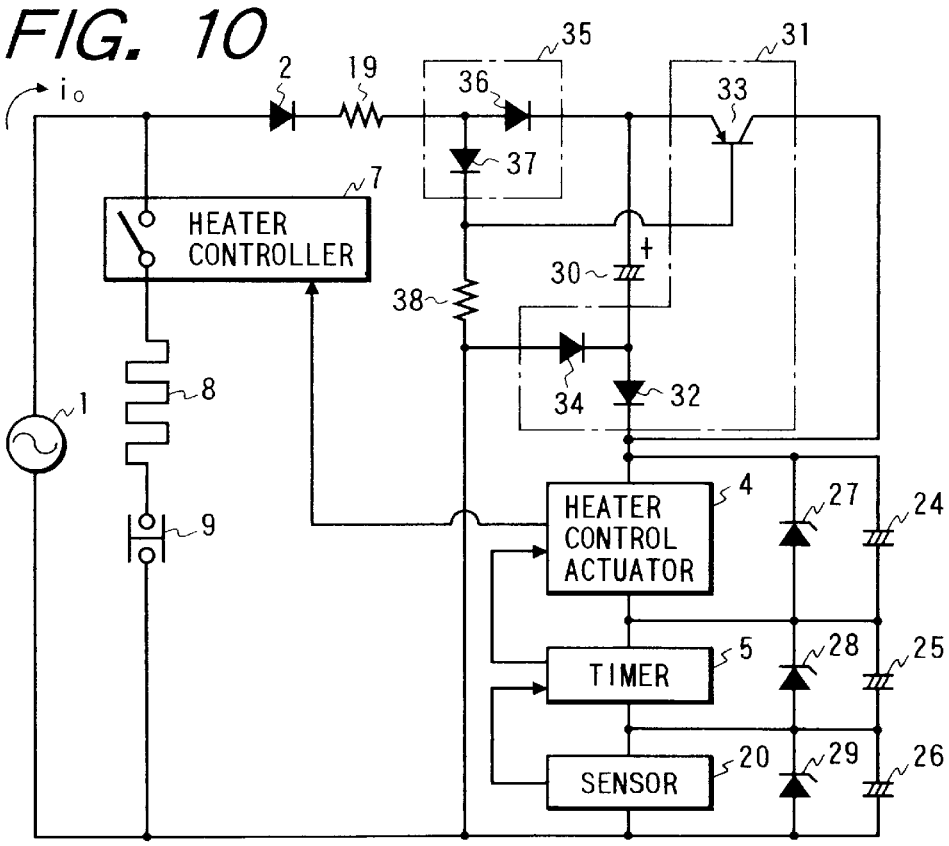
FIG. 10 is a circuit block diagram showing an electronic iron in accordance with a fifth embodiment of the present invention.

FIG. 10 shows a circuit arrangement in accordance with a fifth embodiment of the present invention, which is different from the arrangement of FIG. 7 in that three capacitors 24–26 and three Zener diodes 27–29 are additionally provided in parallel to heater control actuator 4, timer 5 and sensor 20 serving as control means of the present invention.

More specifically, the heater control actuator 4 is connected in parallel with first capacitor 24 and an associated first Zener diode 27. The timer 5 is connected in parallel with second capacitor 25 and an associated second Zener diode 28. The sensor 20 is connected in parallel with third capacitor 26 and an associated third Zener diode 29.

Capacitors 24–26 and Zener diodes 27–29 cooperatively serve as the stable direct-current power source capable of stabilizing the supply of direct current to corresponding one of heater control actuator 4, timer 5 and sensor 20.

An operation of the above-described circuit will be explained hereinafter. When the commercial power source 1 has the positive polarity, electric power is applied from the output terminal of voltage drop element 19 through capacitor 30 to serially connected three capacitors 24–26. At the same time, electric current is supplied to Zener diodes 27–29, heater control actuator 4, timer 5 and sensor 20.

When the commercial power source 1 has the negative polarity, power supply from the commercial power source 1 is stopped by the diode 2. During this negative-polarity duration, capacitor 30 supplies electric current to each of heater control actuator 4, timer 5 and sensor 20 from through a switching circuit 31. Furthermore, capacitors 24–26 supply electric current to the corresponding one of heater control actuator 4, timer 5 and sensor 20. Output voltages of capacitors 24–26 are stabilized by the provision of Zener diodes 27–29, respectively.

As apparent from the foregoing description, the fifth embodiment of the present invention provides heater control actuator 4, timer 5 and sensor 20, three capacitors 24–26 connected in parallel to these control units 4, 5 and 20 respectively, and three Zener diodes 27–29 connected in parallel to these capacitors 24–26 respectively.

According to the fifth embodiment, a significant amount of output voltage of commercial power source 1 is applied between both ends of capacitor 30 as a divided voltage other than the divided voltages applied to heater control actuator 4, timer 5 and sensor 20, reducing the voltage drop amount at the voltage drop element 19.

As the electric current flowing through voltage drop element 19 is small, the total amount of electric power consumption at the voltage drop element 19 can be suppressed to an extremely small value. The circuit of the fifth embodiment can be operated effectively even the duration the commercial power source 1 has the polarity opposed to the flow direction of electric current i0.

Thus, the fifth embodiment of the present invention is characterized in that the control means comprises a plurality of control units each being connected in parallel with a dedicated capacitor and a Zener diode, in addition to the essential features of the fourth embodiment. It becomes possible to fairly reduce power loss and provide a stable direct-current voltage for each control means.

Mounting Arrangement

Figure 11:
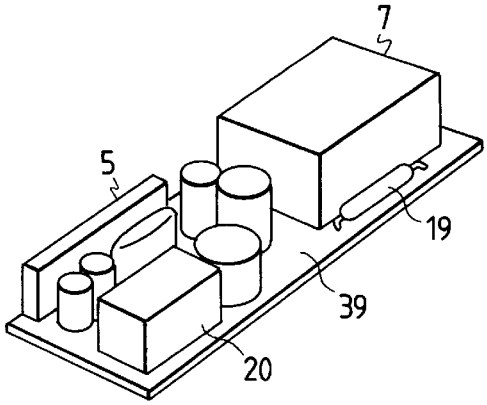
FIG. 11 is a perspective view showing a printed circuit board mounting various iron control units together with a voltage drop element in accordance with first through fifth embodiments of the present invention.
Figure 12:
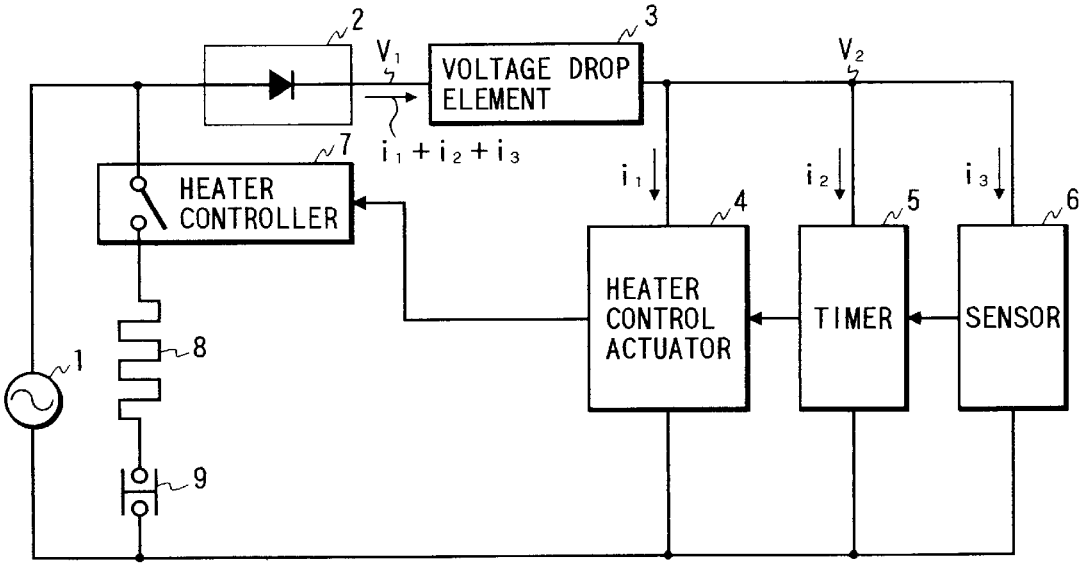
FIG. 12 PRIOR ART
FIG. 12 is a circuit block diagram showing a conventional electronic iron.
Figure 13A:
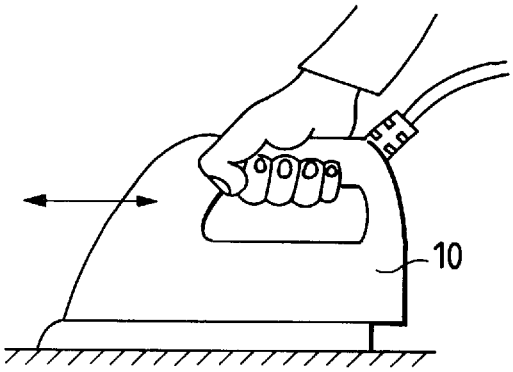
FIG. 13A is a side view illustrating the characteristic movement of the electronic iron which is moved by an operator.
Figure 13B:
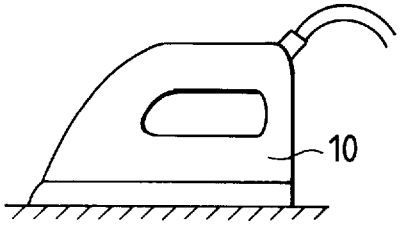
FIG. 13B is a side view illustrating the iron which is not moving and resting on a horizontal surface.
Figure 13C:
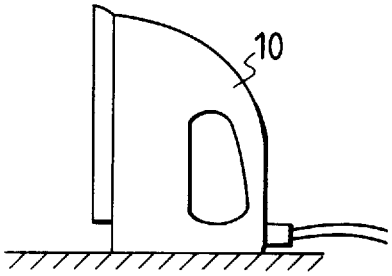
FIG. 13C is a side view illustrating the iron left in the heel rest position.
Figure 14:
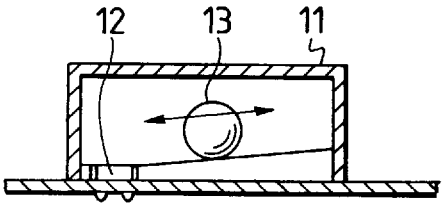
FIG. 14 PRIOR ART
FIG. 14 is a cross-sectional view showing a movement detecting sensor used in an iron.
Figure 15:
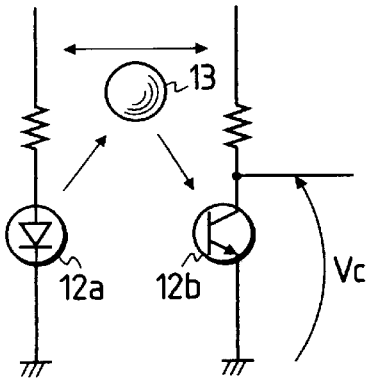
FIG. 15 PRIOR ART
FIG. 15 is a circuit diagram showing detailed circuit of the sensor shown in FIG. 14.
Figure 16A:
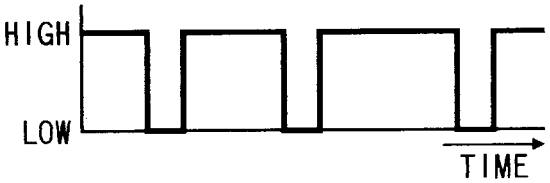
FIG. 16A is a time chart showing a typical waveform of the output voltage obtained from the sensor when the iron is used.
Figure 16B:
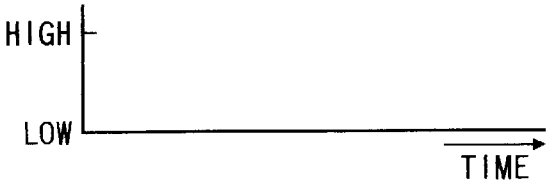
FIGS. 16B and 16C are a time chart showing a typical waveform of the output voltage obtained from the sensor when the iron is not used.
Figure 16C:
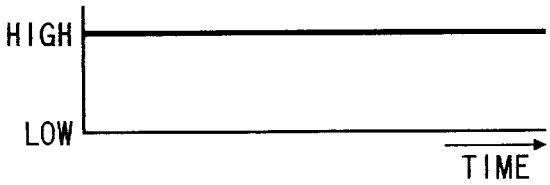
Figure 17:
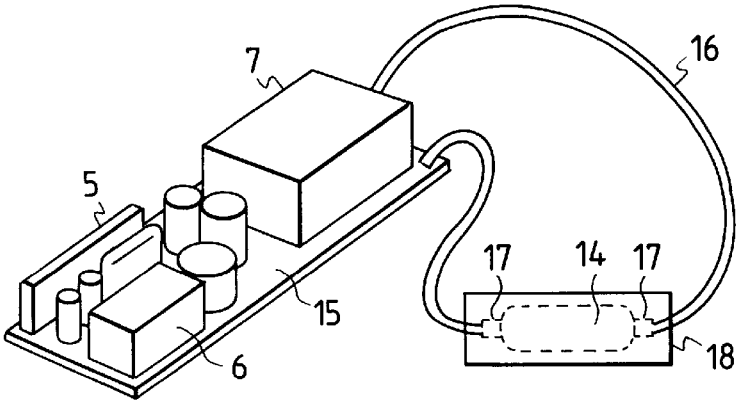
FIG. 17 PRIOR ART
FIG. 17 is a perspective view showing an assembly of various iron control components and a heat-generating voltage drop element mounted on a printed circuit board.

FIG. 11 is a perspective view showing a practical mounting arrangement of an electronic component assembly relating to the first to fifth embodiments. As shown in FIG. 11, the heat-generating voltage drop element 19 is mounted on a printed circuit board 39 together with timer 5, sensor 20, heater controller 7 and other electronic components shown in FIGS. 1–10.

As described in the foregoing description, the present invention suppresses power consumption at the voltage drop element 19, reducing heat generation therefrom. Hence, the present invention makes it possible to mount the voltage drop element on a printed circuit board having a low durable temperature.

More specifically, there is provided an electronic pressing iron comprising: a diode rectifying an output voltage of a commercial power source; voltage drop means connected to the diode for partially dropping a rectified output voltage of the commercial power source; a plurality of control units connected to the voltage drop means and operated by a voltage supplied through the voltage drop means, wherein the voltage drop means is connected in series with at least two of the plural control units, and is mounted on a printed circuit board together with the plural control units.

Hence, it becomes possible to supply the circuit of control means with an electric current comparable with or not larger than the maximum current among the electric currents required for operating the plural control units respectively, resulting in the reduction of electric current flowing through the voltage drop element.

Furthermore, the sum of voltages applied on plural control units is identical with the required output voltage of the voltage drop element. Series connection of the voltage drop element and at least two control units makes it possible to reduce the required voltage drop amount at the voltage drop element, suppressing overall electric power consumption (i.e. heat generation) at the voltage drop element.

Hence, it finally becomes possible to mount the voltage drop means, which is a heat generation source, on a printed circuit board normally having a lower durable temperature. Thus, installation can be facilitated, and reliability can be increased.

Furthermore, there is provided an electronic pressing iron comprising: a diode rectifying an output voltage of a commercial power source; voltage drop means connected to the diode for partially dropping a rectified output voltage of the commercial power source; control means connected to the voltage drop means and operated by a voltage supplied through the voltage drop means; a capacitor; and switching means for switching the connection between the capacitor and the control means, in such a manner that the capacitor is connected in series with the control means when the control means receives electric power through the diode, while the capacitor is connected in parallel with the control means when the control means receives no electric power through the diode, wherein the voltage drop means is mounted on a printed circuit board together with the control means.

When electric power is supplied to the control means through the diode, it becomes possible to connect the control means in series with the capacitor, thereby effectively charging the capacitor and causing a significant amount of voltage drop at the capacitor. On the other hand, when electric power is not supplied to the control means through the diode, it becomes possible to connect the control means in parallel with the capacitor by the switching means activated in response to the discharge current of the -capacitor, thereby effectively discharging the electric charge stored in the capacitor to the control means. In response to this discharge current, each control means is operated.

When the control means receives electric power through the diode, the current flowing through the voltage drop element is suppressed to a small value since the capacitor is connected in series with the voltage drop element. The required voltage drop amount is also suppressed to a small value. As a result, overall power consumption at the voltage drop element can be suppressed to a fairly small value.

Hence, it finally becomes possible to mount the voltage drop means, which is a heat generation source, on a printed circuit board normally having a lower durable temperature, with facilitation in the installation and enhancement of the reliability.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. An electronic pressing iron comprising a housing a sole plate within said housing heated by an electric heater adapted to receive electric power from a commercial power source further comprising:

a diode rectifying an output voltage of said commercial power source;

voltage drop means connected to said diode for partially dropping a rectified output voltage of said commercial power source;

a plurality of control units for controlling said electric heater connected to said voltage drop means and operated by a voltage supplied through said voltage drop means, wherein said voltage drop means is connected in series with at least two of said control units which are serially connected to each other.

2. The electronic pressing iron defined by claim 1, wherein said plurality of control units includes a heater control actuator controlling power supply to a heater element heating a base of said iron, a sensor detecting movement of said iron, and a timer responsive to an output of said sensor and causing said heater control actuator to stop power being supplied to said heater element after the passage of a predetermined period of time.

3. The electronic pressing iron defined by claim 2, wherein said sensor comprises a photo coupler separated into a light emitting portion and a light receiving portion, and a ball rollable in response to the movement of said iron, wherein said light receiving portion constitutes a Darlington amplifier having a photo transistor and an associated transistor.

4. An electric pressing iron comprising a housing having a handle, a sole plate heated by an electronic heater adapted to receive electric power from a commercial source of power further comprising:

a diode rectifying an output voltage of a commercial power source;

voltage drop means connected to said diode for partially dropping a rectified output voltage of said commercial power source;

a plurality of control units for controlling said electric heater, connected to said voltage drop means and operated by a voltage supplied through said voltage drop means, wherein said voltage drop means is connected in series with at least two of said plural control units which are serially connected to each other, and is mounted on a printed circuit board together with said control units.

* * * * *